US012416131B2

(12) United States Patent
Suzuki et al.

(10) Patent No.: US 12,416,131 B2
(45) Date of Patent: Sep. 16, 2025

(54) WORK MACHINE

(71) Applicant: HITACHI CONSTRUCTION MACHINERY CO., LTD., Tokyo (JP)

(72) Inventors: Yusuke Suzuki, Tsukuba (JP); Hiroaki Tanaka, Kasumigaura (JP); Yasuhiko Kanari, Kasumigaura (JP); Hiroshi Sakamoto, Kashiwa (JP); Teruki Igarashi, Tsuchiura (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 179 days.

(21) Appl. No.: 18/023,448

(22) PCT Filed: Dec. 10, 2021

(86) PCT No.: PCT/JP2021/045582
§ 371 (c)(1),
(2) Date: Feb. 27, 2023

(87) PCT Pub. No.: WO2022/163168
PCT Pub. Date: Aug. 4, 2022

(65) Prior Publication Data

US 2023/0332375 A1 Oct. 19, 2023

(30) Foreign Application Priority Data

Jan. 29, 2021 (JP) ..... 2021-013157

(51) Int. Cl.
*E02F 3/43* (2006.01)
*E02F 9/22* (2006.01)
*E02F 9/26* (2006.01)

(52) U.S. Cl.
CPC ..... *E02F 3/435* (2013.01); *E02F 9/2203* (2013.01); *E02F 9/262* (2013.01); *E02F 9/265* (2013.01); *E02F 9/2285* (2013.01)

(58) Field of Classification Search
CPC ..... E02F 3/435; E02F 9/2203; E02F 9/262; E02F 9/265; E02F 9/2285; E02F 3/437
See application file for complete search history.

(56) References Cited

U.S. PATENT DOCUMENTS

2017/0268198 A1* 9/2017 Shimano ..... E02F 3/32
2018/0230672 A1 8/2018 Matsuyama et al.
(Continued)

FOREIGN PATENT DOCUMENTS

JP 2018003513 A * 1/2018
JP 2019-112901 A 7/2019
(Continued)

OTHER PUBLICATIONS

English Translation JP2018003513A (Year: 2024).*
(Continued)

*Primary Examiner* — Rami Khatib
(74) *Attorney, Agent, or Firm* — Mattingly & Malur, PC

(57) ABSTRACT

The invention of the present application intends to provide a work machine that can improve the work performance by keeping the work state of work equipment conforming to the intention of an operator in machine control for causing the work equipment to follow an excavation target surface. For this purpose, a controller determines the work state of the work equipment on the basis of an operation input amount inputted from an operation input device and the posture of the work equipment with respect to the target surface, computes a range of an action command value of actuators in which the work state determined is kept, and corrects, within the range, the action command value of the actuators
(Continued)

to make the distance between the work equipment and the target surface small.

4 Claims, 12 Drawing Sheets

(56) References Cited

U.S. PATENT DOCUMENTS

| | | | | |
|---|---|---|---|---|
| 2020/0224383 | A1* | 7/2020 | Ishida | E02F 3/435 |
| 2020/0399867 | A1* | 12/2020 | Daimon | E02F 9/262 |
| 2020/0407951 | A1* | 12/2020 | Daimon | E02F 9/262 |
| 2021/0062460 | A1 | 3/2021 | Chiba et al. | |
| 2021/0079625 | A1 | 3/2021 | Narikawa et al. | |
| 2021/0230828 | A1* | 7/2021 | Shintani | E02F 9/265 |
| 2022/0010521 | A1* | 1/2022 | Izumikawa | E02F 9/2045 |
| 2022/0220696 | A1* | 7/2022 | Sugiyama | E02F 3/437 |

FOREIGN PATENT DOCUMENTS

| | | | |
|---|---|---|---|
| JP | 2020-002751 | A | 1/2020 |
| JP | 2020-033781 | A | 3/2020 |
| WO | 2017086488 | A1 | 5/2017 |

OTHER PUBLICATIONS

International Preliminary Report on Patentability received in corresponding International Application No. PCT/JP2021/045582 dated Aug. 10, 2023.

International Search Report of PCT/JP2021/045582 dated Feb. 15, 2022.

* cited by examiner

WORK MACHINE

TECHNICAL FIELD

The present invention relates to a work machine used for road work, construction work, civil work, dredging work, demolition work, and so forth.

BACKGROUND ART

As a work machine used for road work, construction work, civil work, dredging work, and so forth, there is known one in which an articulated front work implement is vertically rotatably attached to a work machine main body obtained by swingably attaching a swing structure to an upper part of a track structure that travels by a power system and the respective front components that configure the front work implement are driven by cylinders. As one example thereof, there is what is generally called a hydraulic excavator having a front work implement including a boom, an arm, a bucket, and so forth.

In this kind of hydraulic excavator, there is one that sets in advance an excavation target surface to be excavated and executes what is generally called machine control in which the boom action is automatically controlled according to operation of the arm action by an operator such that the bucket can execute excavation along the excavation target surface.

Incidentally, in this kind of hydraulic excavator, an excavator that automatically controls the action of the bucket is widely known. However, if automatic control of the bucket angle that contradicts the work intention of an operator is executed, the operator is unable to execute intended bucket work, and therefore, the work performance of the hydraulic excavator lowers in some cases.

For example, Patent Document 1 discloses a technique relating to a controller of a construction machine and a control method of a construction machine that execute bucket control conforming to the intention of an operator, by executing bucket control in which the angle of a bucket is kept constant according to the state of operation of the bucket by the operator and the distance between the bucket and an excavation target surface.

PRIOR ART DOCUMENT

Patent Document

Patent Document 1: PCT Patent Publication No. WO2017/086488

SUMMARY OF THE INVENTION

Problem to be Solved by the Invention

In the excavator that executes what is generally called machine control, it is important to cause the bucket to accurately follow the excavation target surface. Incidentally, the bucket can be caused to follow the excavation target surface more accurately when the action of the bucket, in addition to the action of the arm and the boom, is controlled to make the distance between the bucket and the excavation target surface shorter.

However, when the bucket action is controlled to cause the claw tip of the bucket to always come close to the excavation target surface, there is a possibility of deviation from the bucket work state intended by the operator. For example, if the rear end side of the bucket bottom surface opposite to the claw tip of the bucket is located lower than the claw tip side of the bucket with respect to the excavation target surface in excavation by the claw tip side of the bucket, the bottom surface of the bucket comes into contact with the ground surface, making it difficult to continue the excavation work by the claw tip side of the bucket. Further, conversely, if the claw tip side of the bucket is located lower than the rear end side of the bucket with respect to the excavation target surface when rubbing work against a ground surface is being executed by the rear end side of the bottom surface of the bucket, the ground surface is excavated by the claw tip side of the bucket, making it difficult to execute the rubbing work by the bucket.

The present invention is made in view of the above-described problem and intends to provide a work machine that is capable of improving the work performance by keeping the work state of work equipment conforming to the intention of an operator in machine control for causing the work equipment to follow an excavation target surface.

Means for Solving the Problem

In order to achieve the above-described object, in the present invention, in a work machine including a machine main body, a front work implement that is attached to the machine main body vertically rotatably and has a work equipment, actuators that drive the front work implement, a drive system that drives the actuators, an operation input device that gives an instruction regarding an action of the actuators, a posture sensor that senses the posture of the machine main body and the front work implement, a target surface information setting device that sets a target surface that is to be excavated with the work equipment, and a controller that computes an action command value of the actuators on the basis of information inputted from the operation input device, the posture sensor, and the target surface information setting device, to cause the work equipment to move along the target surface, and outputs the action command values to the drive system, the controller is configured to determine a work state of the work equipment on the basis of an operation input amount inputted from the operation input device and the posture of the work equipment with respect to the target surface, compute a range of the action command value of the actuators in which the work state determined is kept, and correct, within the range, the action command value of the actuators to make the distance between the work equipment and the target surface shorter.

According to the present invention configured as above, it becomes possible to improve the work performance of the work machine by keeping the work state of the work equipment conforming to the intention of the operator in machine control for causing the work equipment to follow the excavation target surface.

Advantages of the Invention

According to the present invention, it becomes possible to improve the work performance of a work machine by keeping the work state of work equipment conforming to the intention of an operator in machine control for causing the work equipment to follow an excavation target surface.

MODES FOR CARRYING OUT THE INVENTION

Description will be given below with reference to the drawings with a hydraulic excavator taken as an example as a work machine in an embodiment of the present invention. An equivalent component is given the same numeral in the respective diagrams, and overlapping description is omitted as appropriate.

<Hydraulic Excavator>

Figure 1:
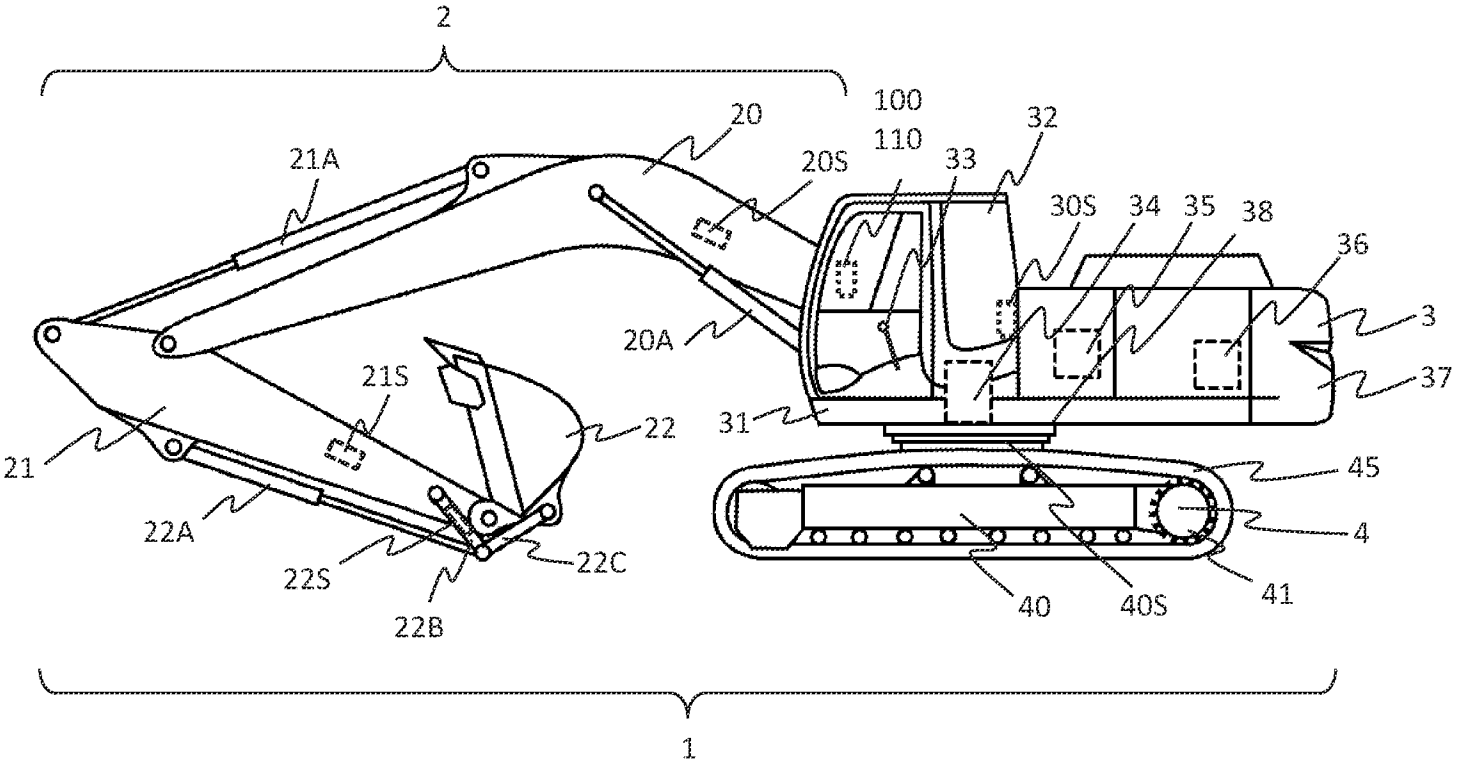
FIG. 1 is a side view of a hydraulic excavator in an embodiment of the present invention.

FIG. 1 is a side view of a hydraulic excavator in the present embodiment. As illustrated in FIG. 1, a hydraulic excavator 1 includes a front work implement 2, a swing structure 3 that configures a machine main body, and a track structure 4.

Provided is a configuration in which the front work implement 2 and the swing structure 3 pivot relative to the swing structure 3 and the track structure 4, respectively, around a joint part. The front work implement 2 includes a boom 20 whose one end is joined to the swing structure 3, an arm 21 whose one end is joined to the boom 20, a bucket 22 whose one end is joined to the arm 21, a boom cylinder 20A whose two ends are joined to the boom 20 and the swing structure 3, respectively, and an arm cylinder 21A whose two ends are joined to the arm 21 and the boom 20, respectively.

The front work implement 2 further includes a first link 22B whose one end is joined to the arm 21, a second link 22C whose one end is joined to the bucket 22, and a bucket cylinder 22A whose one end is joined to the other ends of the first link 22B and the second link 22C and whose other end is joined to the arm 21. These components are each configured to vertically pivot around the joint part. The track structure 4 includes a motor 41 for travelling and a crawler 45.

The boom cylinder 20A, the arm cylinder 21A, and the bucket cylinder 22A have such a structure as to each extend and contract by the hydraulic pressure and can respectively cause the boom 20, the arm 21, and the bucket 22 to pivot through extension and contraction. The bucket 22 can freely be replaced by an unillustrated attachment, such as a grapple, a breaker, a ripper, or a magnet.

A boom IMU (Inertial Measurement Unit) 20S for sensing the posture of the boom 20 is attached to the boom 20. An arm IMU 21S for sensing the posture of the arm 21 is attached to the arm 21. A bucket IMU for sensing the posture of the bucket 22 is attached to the first link 22B. The boom IMU 20S, the arm IMU 21S, and the bucket IMU 22S are each configured with an angular velocity sensor and an acceleration sensor.

The swing structure 3 includes a swing structure IMU 30S, a main frame 31, a cab 32, an information processing device 34, a drive system 35, a prime mover device 36, a counterweight 37, and a motor 38 for swing. The swing structure IMU 30S, the cab 32, the information processing device 34, the drive system 35, the prime mover device 36, the counterweight 37, and the motor 38 for swing are disposed over the main frame 31. The swing structure IMU 30S includes an acceleration sensor and an angular velocity sensor and can sense the inclination angle of the swing structure 3.

Figure 2:
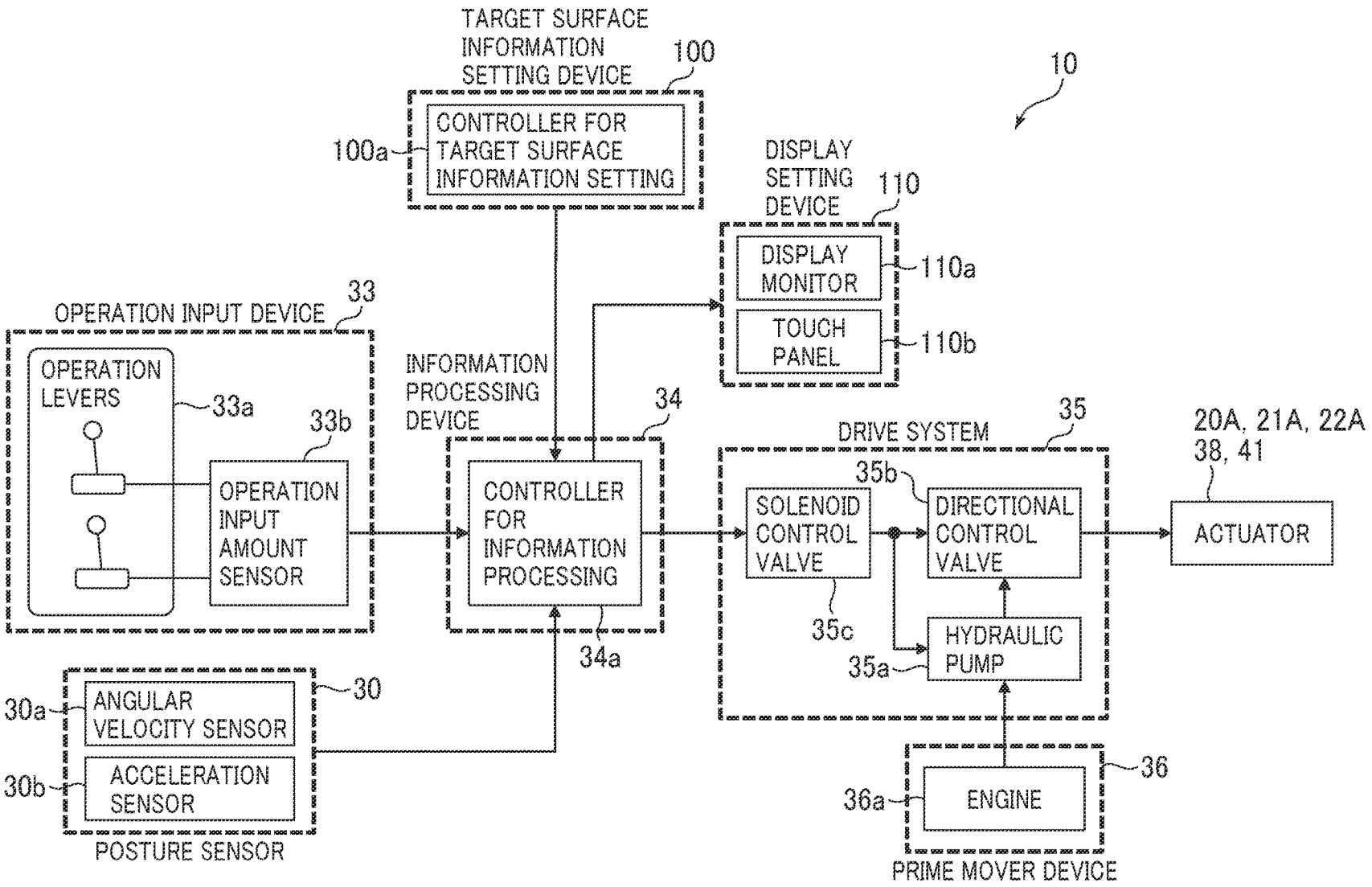
FIG. 2 is a diagram illustrating the configuration of a control system of the hydraulic excavator illustrated in FIG. 1.

In the cab 32, an operation input device 33, a target surface information setting device 100, and a display setting device 110 are disposed. The operation input device 33 is configured by operation levers 33*a* and an operation input amount sensor 33*b* (both are illustrated in FIG. 2) that senses the amount of operation of the operation levers 33*a* performed by an operator. The operation input amount sensor 33*b* can convert each of target actions of the respective movable parts requested by the operator to an electrical signal by sensing the operation amount of the operation levers 33*a*. The operation input device 33 may be one of a hydraulic pilot system or a system that allows operation from a remote place. The target surface information setting device 100 can set an excavation target surface that becomes a target of excavation by the front work implement 2.

The display setting device 110 is configured with a display monitor and a touch panel and can display the posture of the hydraulic excavator 1, information regarding the excavation target surface, the positional relation and the distance between the excavation target surface and the front work implement 2, and so forth and set various dimensions and mass of the front work implement 2. Furthermore, the display setting device 110 can set an actuation mode relating to keeping of the angle of the bucket 22.

The information processing device 34 will be described later with reference to FIG. 3.

The drive system 35 is configured with a hydraulic pump 35*a*, a directional control valve 35*b*, and a solenoid control valve 35*c*. The hydraulic pump 35*a* generates the hydraulic pressure necessary for operation of the hydraulic excavator 1. The solenoid control valve 35*c* drives the directional control valve 35*b* according to an action command value inputted from the information processing device 34. The directional control valve 35*b* controls the flow rate and the direction of a hydraulic fluid supplied from the hydraulic pump 35*a* to the boom cylinder 20A, the arm cylinder 21A, the bucket cylinder 22A, the motor 38 for swing, and the motor 41 for travelling that are actuators.

The prime mover device 36 is a power source of the hydraulic pump 35*a* and is configured by an engine 36*a*.

The track structure 4 includes a track frame 40, the motor 41 for travelling, and the crawler 45. The crawler 45 is installed to be capable of going around the track frame 40 by the motor 41 for travelling. The operator can adjust the travelling speed of the hydraulic excavator 1 by operating the operation input device 33 and changing the rotation speed of the motor 41 for travelling. The track structure 4 is not limited to one that includes the crawler 45 and may be one that includes travelling wheels or legs.

<Configuration of Control System>

The configuration of a control system of the hydraulic excavator 1 is illustrated in FIG. 2. In FIG. 2, a control system 10 is configured by the operation input device 33, a posture sensor 30, the target surface information setting device 100, the display setting device 110, the information processing device 34, the drive system 35, and the prime mover device 36.

The operation input device 33 is configured with the operation levers 33*a* and the operation input amount sensor 33*b*. The operation amount of the operation levers 33*a* is converted to an electrical signal by the operation input amount sensor 33*b* and is inputted to the information processing device 34.

The posture sensor 30 includes an angular velocity sensor 30*a* and an acceleration sensor 30*b* and can measure the angle of the respective components of the front work implement 2 and the swing structure 3.

The target surface information setting device 100 includes a controller 100*a* for target surface information setting and can set and manage the excavation target surface.

The display setting device 110 includes a display monitor 110*a* and a touch panel 110*b* and can display, for the operator, the posture of the hydraulic excavator 1, area information regarding the excavation target surface set by the target surface information setting device 100, the distance from the front work implement 2 to the excavation target surface, and so forth. Moreover, the display setting device 110 can set the respective dimensions of the boom 20, the arm 21, and the bucket 22 in order to execute accurate machine control. Further, regarding angle control of the bucket 22, the display setting device 110 can select a mode to automatically keep the angle of the bucket 22 with respect to the excavation target surface, a mode to automatically keep the angle of the bucket 22 with respect to the swing plane of the swing structure 3 according to the action of the arm 21 and the boom 20, a mode to keep the angle of the bucket 22 with respect to the arm 21, and so forth.

The information processing device 34 includes a controller 34*a* for information processing and processes control signals and sensing signals from the respective devices. The operation input device 33, the posture sensor 30, the target surface information setting device 100, and the display setting device 110 are connected to the information processing device 34. Moreover, the information processing device 34 outputs a command for driving the hydraulic excavator 1 to the drive system 35.

The drive system 35 is configured by the hydraulic pump 35*a*, the directional control valve 35*b*, and the solenoid control valve 35*c*. The hydraulic pump 35*a* generates the hydraulic fluid necessary for driving the hydraulic cylinders 20A, 21A, and 22A and the hydraulic motors 38 and 41. The directional control valve 35*b* drives the hydraulic cylinders 20A, 21A, and 22A and the hydraulic motors 38 and 41 by adjusting the flow rate and the direction of the hydraulic fluid supplied from the hydraulic pump 35*a*. Further, the drive system 35 can drive attachment and equipment that are not included in the above.

The prime mover device 36 is configured by the engine 36*a*. The engine 36*a* drives the hydraulic pump 35*a*. The prime mover device 36 is not limited to this configuration, and another power source such as an electric motor may be used.

<Operation Input Device>

In general, the hydraulic excavator 1 is configured such that the action velocity of the actuator becomes higher as the operation amount of the operation lever 33*a* becomes larger. The operator can change the action velocity of the respective actuators 20A, 21A, 22A, 38, and 41 by adjusting the operation amount of the operation levers 33*a*.

The operation input device 33 includes the operation input amount sensor 33*b* that electrically senses the operation amount (operation input amount) of the operation levers 33*a* and can transmit the target action of the actuators requested by the operator to the information processing device 34. The operation input amount sensor 33*b* is not limited to one that directly senses the operation amount of the operation levers 33*a* and may be of a system that senses the operation pilot pressure.

<Posture Sensor>

The posture sensor 30 includes an angular velocity sensor and an acceleration sensor in each of the swing structure IMU 30S, the boom IMU 20S, the arm IMU 21S, and the bucket IMU 22S. The angular velocity and acceleration information at the respective positions can be obtained by these IMUs. The boom 20, the arm 21, the bucket 22, the boom cylinder 20A, the arm cylinder 21A, the bucket cylinder 22A, the first link 22B, the second link 22C, and the swing structure 3 are each attached to be capable of rocking. Hence, the posture of the boom 20, the arm 21, the bucket 22, and the swing structure 3 can be estimated from the mechanical link relation. The sensing method of the posture illustrated here is one example. The relative angle of the respective parts of the front work implement 2 may be directly measured, or the posture of the respective parts of the hydraulic excavator 1 may be computed through sensing the stroke of the boom cylinder 20A, the arm cylinder 21A, and the bucket cylinder 22A.

<Target Surface Information Setting Device>

The target surface information setting device 100 can set an excavation target surface deemed as an excavation target by the front work implement 2. The excavation target surface may be set to have multiple planes in addition to having a single plane, and setting a range in which the front work implement 2 can execute excavation may be allowed. The excavation target surface may be set on a coordinate system based on the work machine 1 or may be set on a coordinate system based on the Earth. The setting method of the excavation target surface may be causing model data such as 3D data to be read in.

<Drive System>

The drive system 35 is configured by the hydraulic pump 35*a*, the directional control valve 35*b*, and the solenoid control valve 35*c* and controls the flow rate of the hydraulic operating fluid (hydraulic fluid) to be supplied to the actuators (hydraulic cylinders 20A, 21A, and 22A and the hydraulic motors 38 and 41) that drive the respective parts of the hydraulic excavator 1 according to an action command value inputted from the information processing device 34. The action command value inputted from the information processing device 34 is converted to a pilot pressure by the solenoid control valve 35*c*, and the directional control valve 35*b* is driven by this pilot pressure. The directional control valve 35*b* controls the action velocity of the actuators 20A, 21A, 22A, 38, and 41 by adjusting the flow rate of the hydraulic operating fluid supplied to the actuators 20A, 21A, 22A, 38, and 41.

<Information Processing Device>

Figure 3:
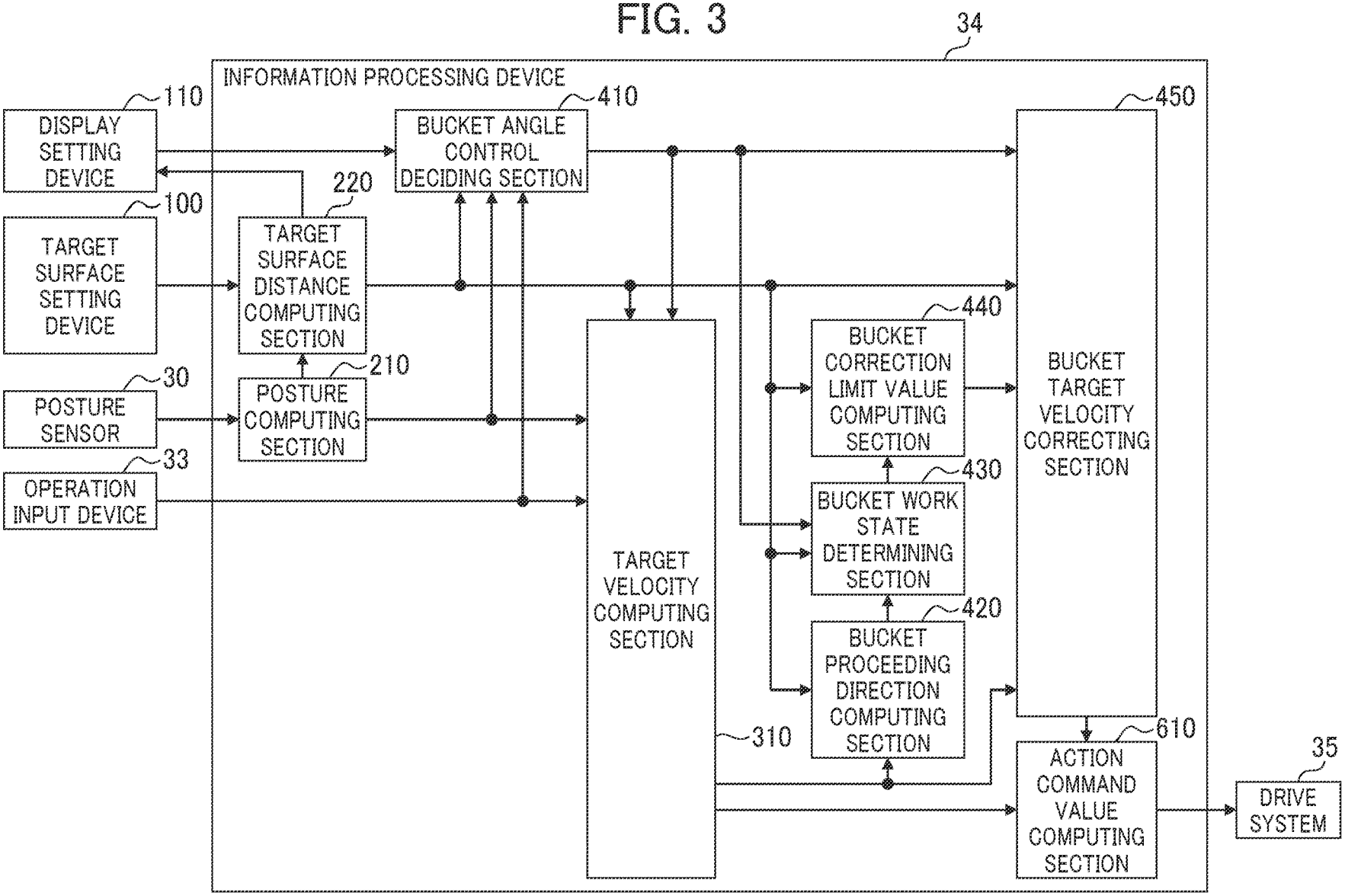
FIG. 3 is a functional block diagram of an information processing device illustrated in FIG. 2.

FIG. 3 is a functional block diagram of the information processing device 34. As illustrated in FIG. 3, the information processing device 34 is connected to the posture sensor 30, the operation input device 33, the target surface information setting device 100, the display setting device 110, and the drive system 35. The information processing device 34 is configured by a posture computing section 210, a target surface distance computing section 220, a target velocity computing section 310, a bucket angle control deciding section 410, a bucket proceeding direction determining section 420, a bucket work state determining section 430, a bucket correction limit value computing section 440, a bucket target velocity correcting section 450, and an action command value computing section 610.

The posture computing section 210 computes the posture of the front work implement 2 and the swing structure 3 on the basis of signals sensed by the posture sensor 30. The computation result of the posture computing section 210 is outputted to the target surface distance computing section 220, the bucket angle control deciding section 410, and the target velocity computing section 310.

The target surface distance computing section 220 computes the distance between multiple freely-selected points set on the bucket 22 and the excavation target surface, on the basis of the computation results of the target surface information setting device 100 and the posture computing section 210. The computation result of the target surface distance computing section 220 is outputted to the display setting device 110, the bucket angle control deciding section 410, the target velocity computing section 310, the bucket proceeding direction determining section 420, the bucket work state determining section 430, the bucket correction limit value computing section 440, and the bucket target velocity correcting section 450.

Regarding angle control of the bucket 22 set by the display setting device 110, the bucket angle control deciding section 410 decides a control state relating to the angle control of the bucket 22 on the basis of the operation input amount from the operation input device 33 and the computation results of the posture computing section 210 and the target surface distance computing section 220 and outputs the result thereof to the target velocity computing section 310, the bucket work state determining section 430, and the bucket target velocity correcting section 450.

The target velocity computing section 310 computes the target velocity of the actuators 20A, 21A, and 22A that drive the front work implement 2, on the basis of the operation amount information of the operation input device 33, the distance between the bucket 22 and the excavation target surface computed by the target surface distance computing section 220, the computation result of the bucket angle control deciding section 410, and the computation result of the posture computing section 210. The computation result of the target velocity computing section 310 is outputted to the bucket proceeding direction determining section 420, the bucket target velocity correcting section 450, and the action command value computing section 610.

The bucket proceeding direction determining section 420 determines the direction in which the bucket 22 proceeds, that is, whether the bucket 22 proceeds toward the claw tip side of the bucket 22 or proceeds toward the opposite side of the claw tip (rear end side), on the basis of the computation results of the target surface distance computing section 220 and the target velocity computing section 310, and outputs the result thereof to the bucket work state determining section 430.

The bucket work state determining section 430 determines the work state of the bucket 22, that is, which of the state in which excavation is being executed by the claw tip side of the bucket 22 (excavating state), the state in which rubbing is being executed by the opposite side of the claw tip of the bucket 22 (rubbing state), and the state in which rubbing is being executed by the claw tip side of the bucket 22 (rubbing state) the work state is, on the basis of the computation results of the target surface distance computing section 220, the bucket angle control deciding section 410, and the bucket proceeding direction determining section 420, and outputs the result thereof to the bucket correction limit value computing section 440.

The bucket correction limit value computing section 440 computes the upper limit value (bucket correction limit value) of the angle correction amount with which the work state of the bucket 22 is kept, on the basis of the computation results of the target surface distance computing section 220 and the bucket work state determining section 430. Moreover, the bucket correction limit value computing section 440 computes the upper limit value (bucket correction limit value) of the angular velocity correction amount of the bucket 22 with which a sense of discomfort would not be given to the operator. The computation result (bucket correction limit value) of the bucket correction limit value computing section 440 is outputted to the bucket target velocity correcting section 450.

The bucket target velocity correcting section 450 corrects the target velocity of the bucket 22 on the basis of the computation results of the bucket angle control deciding section 410, the target surface distance computing section 220, the bucket correction limit value computing section 440, and the target velocity computing section 310.

The action command value computing section 610 computes the action command value necessary to control the drive system 35 on the basis of the computation results of the target velocity computing section 310 and the bucket target velocity correcting section 450 and outputs the action command value to the drive system 35.

<Action of Machine Control>

Figure 4:
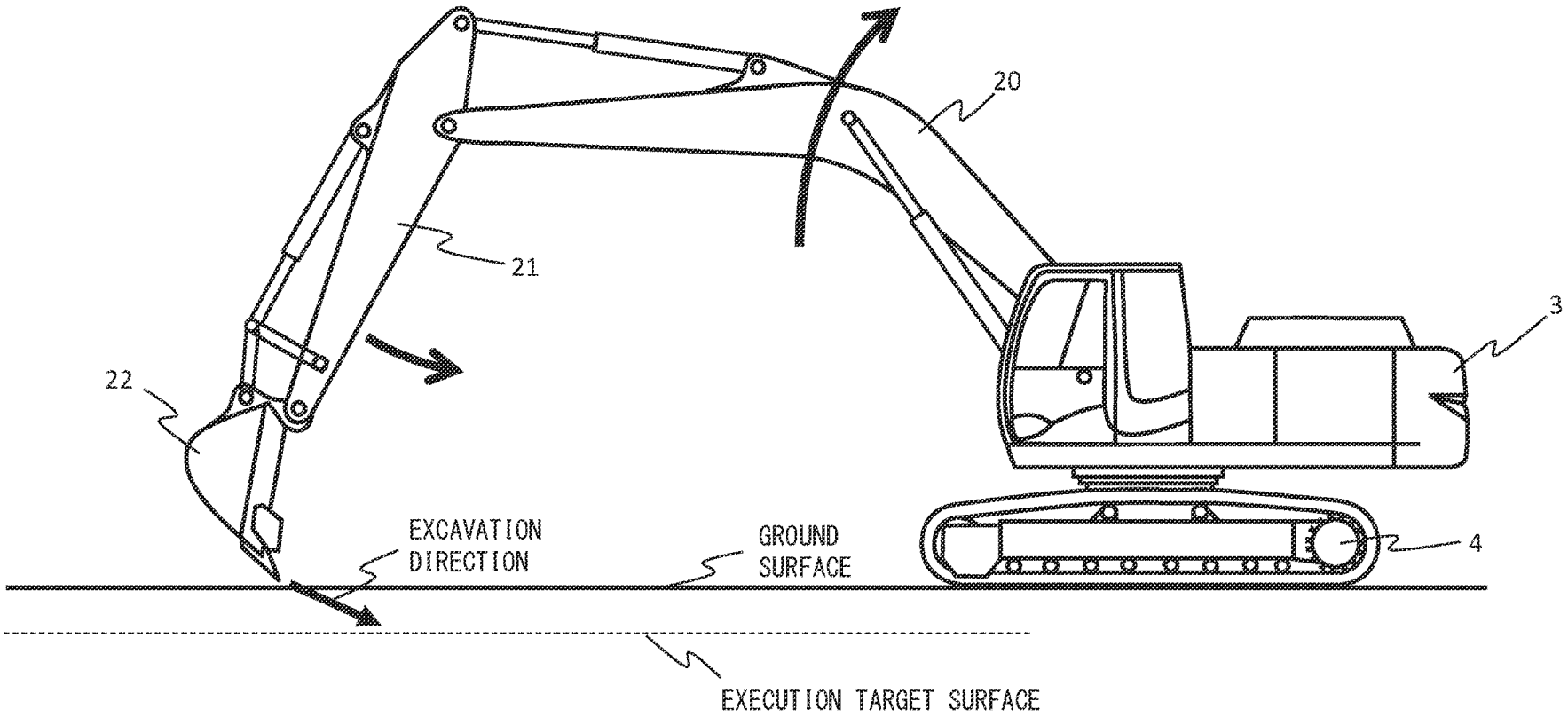
FIG. 4 is a diagram illustrating an action of a front work implement under machine control.

An action of the front work implement 2 under machine control is illustrated in FIG. 4. As illustrated in FIG. 4, in the machine control, the boom 20 is automatically controlled according to the action velocity of the arm 21 to cause the bucket 22 to act along a set excavation target surface. For example, when an operator executes crowding operation of the arm 21 in the state illustrated in FIG. 4, the boom 20 automatically rises or lowers to cause the claw tip of the bucket 22 to move along the excavation target surface. This allows the operator to execute excavation work along the excavation target surface without the need for skillful operation.

Figure 5:
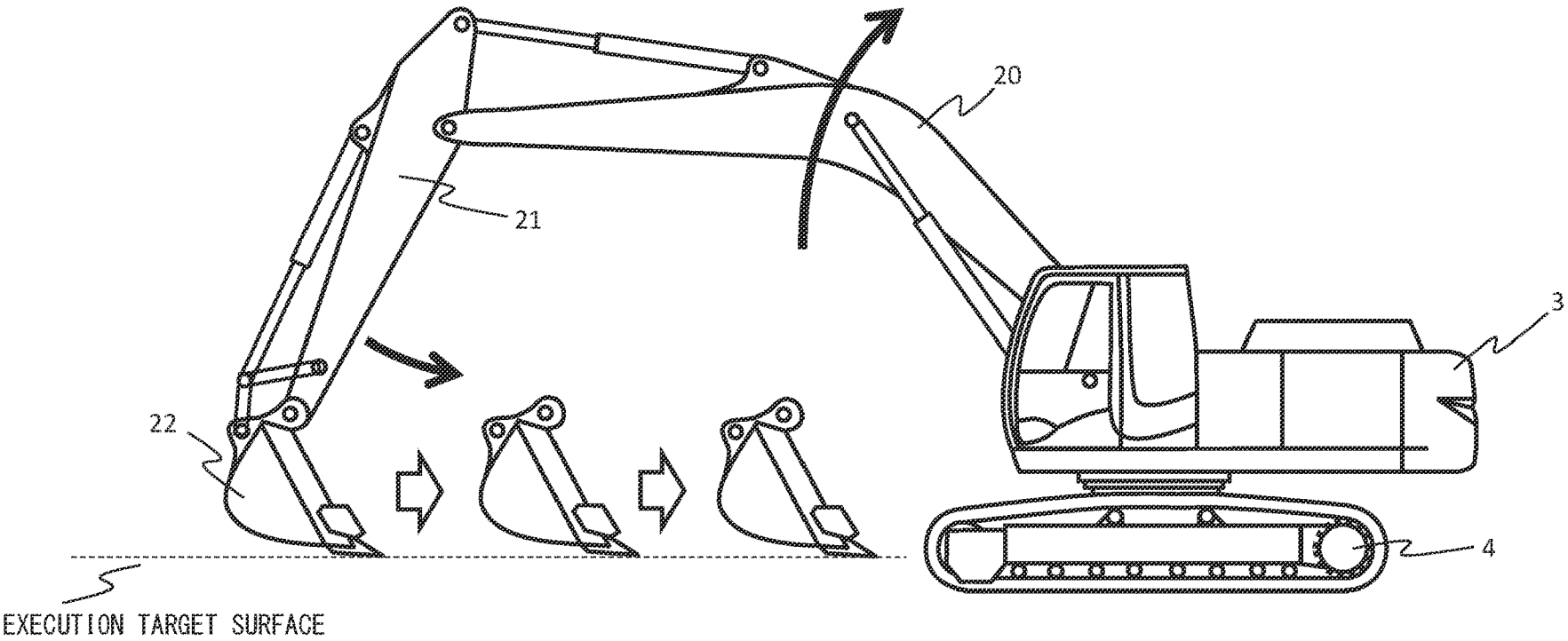
FIG. 5 is a diagram illustrating an action locus of a bucket that is to be achieved by the machine control.

In FIG. 5, an action locus (target action locus) of the bucket 22 that is to be achieved by the machine control is illustrated. As illustrated in FIG. 5, the angle control of the bucket 22 can automatically be executed in the machine control. As the angle control of the bucket 22, there are angle control in which the action of the bucket 22 is controlled to keep the angle of the bucket 22 constant with respect to the excavation target surface, angle control in which the action of the bucket 22 is controlled to keep the angle of the bucket 22 constant with respect to the swing plane of the swing structure 3 according to the action of the boom 20 and the arm 21, and angle control in which the action of the bucket 22 is controlled to keep the angle of the bucket 22 with respect to the arm 21 constant. These kinds of angle control of the bucket 22 can be switched in response to selection operation performed by the operator or can automatically be switched based on the amount of operation of the bucket 22 performed by the operator, the distance between the bucket 22 and the excavation target surface, the posture of the bucket 22 with respect to the excavation target surface, and so forth. For example, in the present embodiment, the action of the bucket 22 is controlled to keep the angle of the bucket 22 with respect to the arm 21 constant in normal times. In the case in which the operator sets the mode to keep the angle of the bucket 22 through the display setting device 110 and the action velocity of the bucket 22 requested by the operator is lower than the action velocity of the bucket 22 requested by the machine control, the action of the bucket 22 is controlled to keep the angle of the bucket 22 constant with respect to the swing plane of the swing structure 3 when the distance between the bucket 22 and the excavation target surface becomes shorter than a predetermined value and the bottom surface of the bucket 22 becomes parallel to the excavation target surface.

<Action Locus of Bucket>

Figure 6:
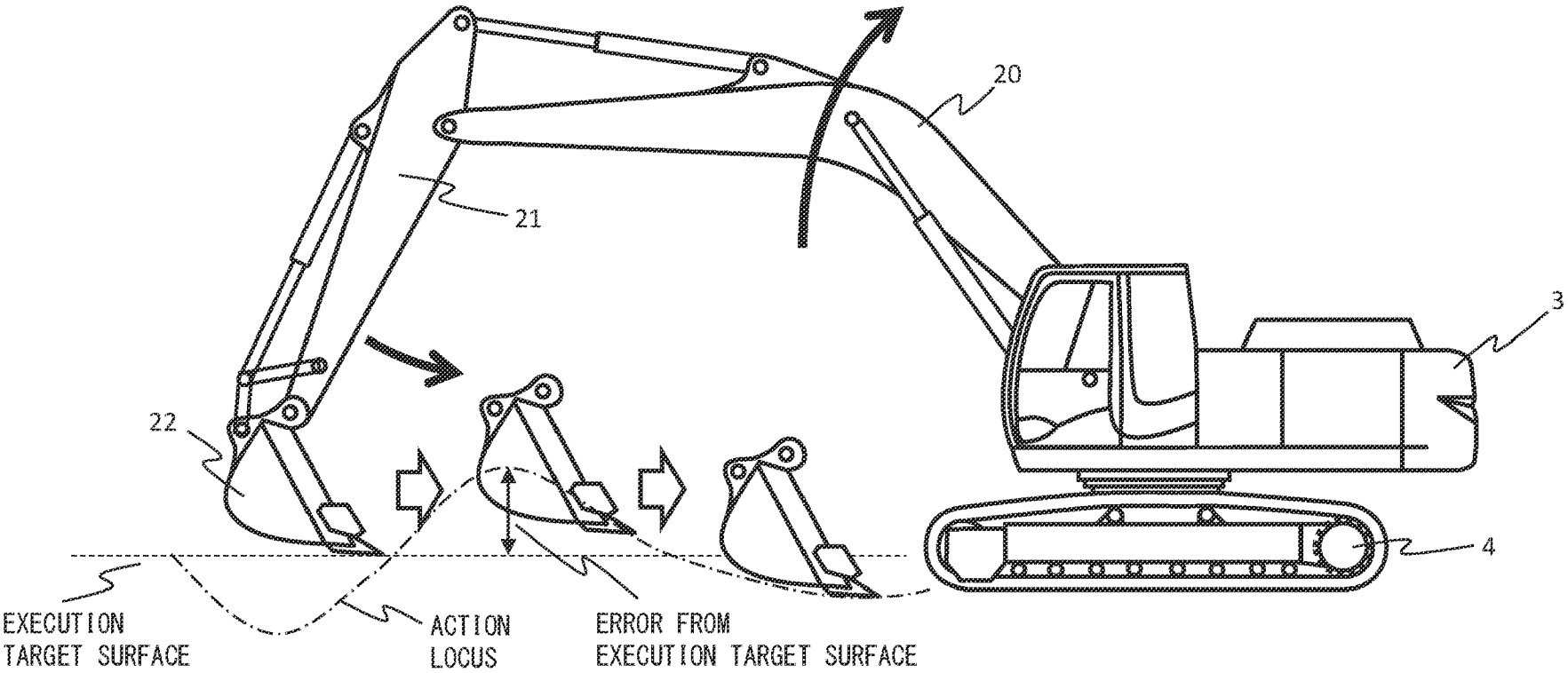
FIG. 6 is a diagram illustrating an actual action locus of the bucket under the machine control.

In FIG. 6, an actual action locus of the bucket 22 based on the machine control is illustrated. In general, in the hydraulic excavator 1, the front work implement 2 is fabricated to be massive in terms of the strength, and hence, the mass is relatively large, and the inertia is large. Moreover, in the case of the hydraulic system, the hydraulic operating fluid that drives the front work implement 2 is fluid with compressibility, and hence, it is difficult to accurately control the action of the front work implement 2. Accordingly, when causing the bucket 22 to follow the excavation target surface is attempted through actually controlling the action of the arm 21 and the boom 20, a deviation occurs between the bucket 22 and the excavation target surface as illustrated in FIG. 6. As a result, recesses and protrusions are generated in the excavated ground surface. The action locus in FIG. 6 is an image for explanation, and the scale thereof is different from the actual scale.

<Work State of Bucket>

Figure 7:
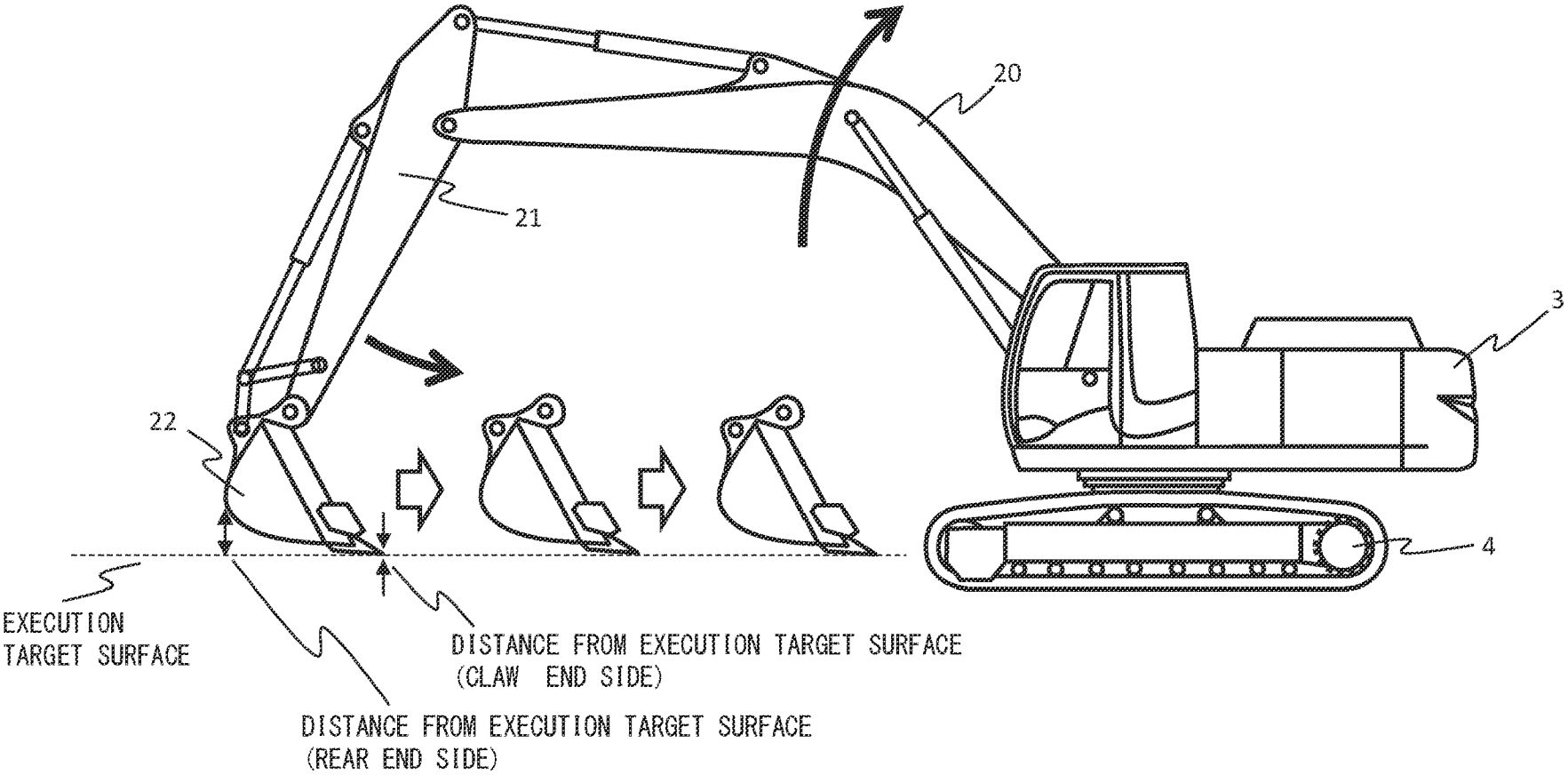
FIG. 7 is a diagram illustrating a target action locus of the bucket in excavation work.
Figure 8:
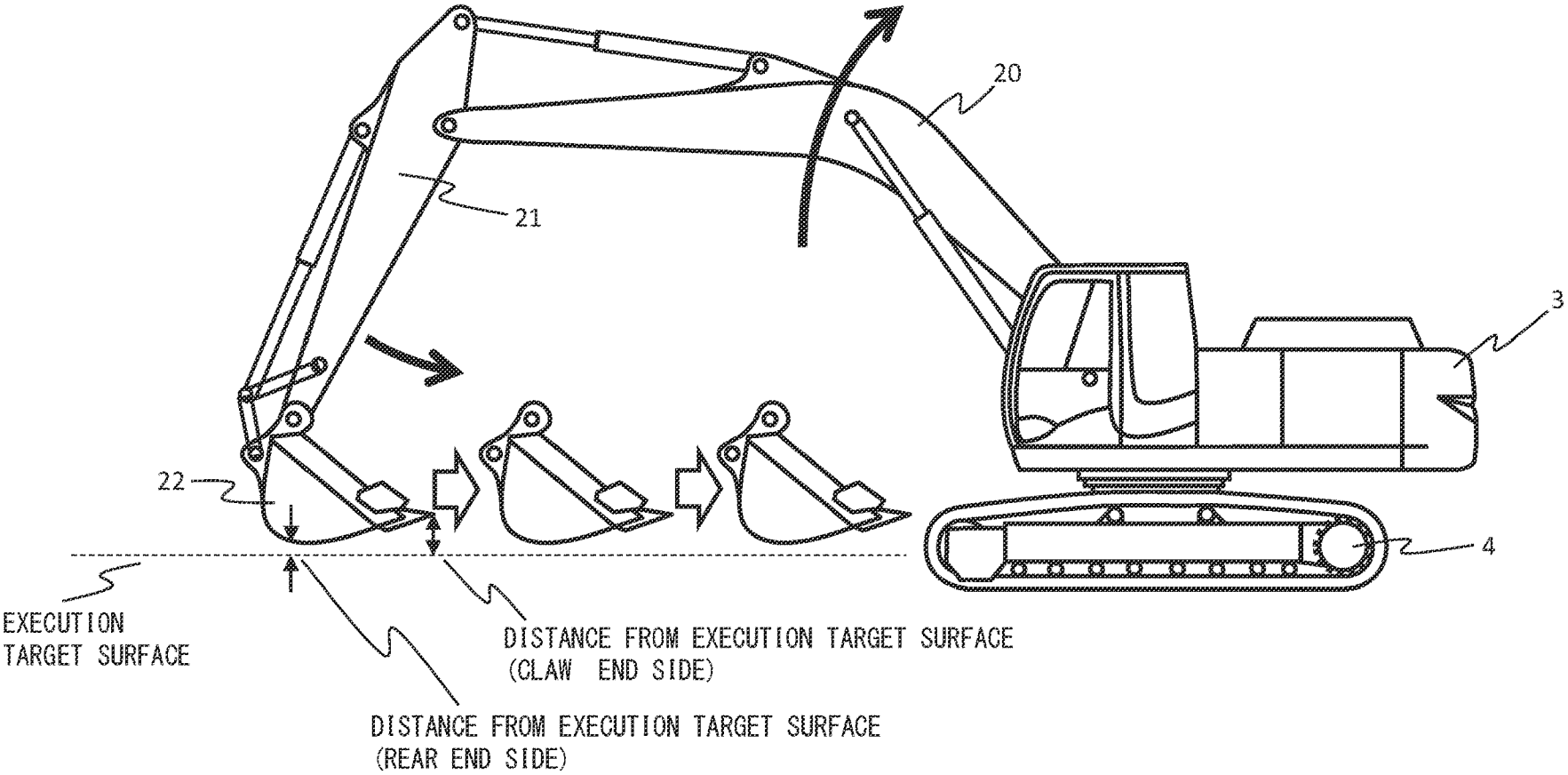
FIG. 8 is a diagram illustrating a target action locus of the bucket in rubbing work.

In FIG. 7, a target action locus of the bucket 22 in excavation work is illustrated. In FIG. 8, a target action locus of the bucket 22 in rubbing work is illustrated. As illustrated in FIG. 7 and FIG. 8, when the bucket 22 is a bucket for excavation widely used in general, a claw called a tooth is attached to the tip side of the bucket 22, and excavation of the ground surface is facilitated. An iron plate is attached to a lower part of the bucket 22 and is used when a ground surface is compacted or a ground surface is smoothly leveled by rubbing the bottom surface or the rear end side of the bucket 22 against the ground surface. As the work state of the bucket 22 when work is executed by the machine control, there are the state in which excavation is executed by the claw tip side of the bucket 22 as illustrated in FIG. 7 (excavating state) and the state in which rubbing is executed by the rear end side opposite to the claw tip of the bucket 22 as illustrated in FIG. 8 (rubbing state). The work (excavation work or rubbing work) of the bucket 22 under the machine control is executed through a series of actions of the front work implement 2, and hence, the work state of the bucket 22 needs to be kept during the work.

Determination of the work state of the bucket 22 can be executed on the basis of the posture and the proceeding direction of the bucket 22 with respect to the excavation target surface. In the present embodiment, the distance between the claw tip side of the bucket 22 and the excavation target surface and the distance between the rear end side opposite to the claw tip side of the bucket 22 and the excavation target surface are computed, and whether the work state is the excavating state or the rubbing state is determined on the basis of the magnitude relation between these distances and the proceeding direction of the bucket 22. The proceeding direction of the bucket 22 can be computed by extracting a direction component parallel to the excavation target surface from the target velocity of the arm 21 and the boom 20. In the configuration of the front work implement 2 illustrated in FIG. 7 and FIG. 8, the bucket 22 proceeds toward the claw tip side through arm crowding action, and the bucket 22 proceeds toward the rear end side opposite to the claw tip through arm dumping action.

One example of conditions for determining that the work state is the excavating state or the rubbing state will be illustrated below.

(i) Condition for determining that the work state is the excavating state

When the bucket 22 proceeds toward the claw tip side in the state in which the claw tip side of the bucket 22 is located lower than the rear end side with the excavation target surface as a reference.

(ii) Condition for determining that the work state is the rubbing state

When the bucket 22 proceeds toward the claw tip side in the state in which the rear end side of the bucket 22 is located lower than the claw tip side with the excavation target surface as a reference. Alternatively, when the bucket 22 proceeds toward the rear end side in the state in which the rear end side of the bucket 22 is located lower than the claw tip side with the excavation target surface as a reference.

Figure 9:
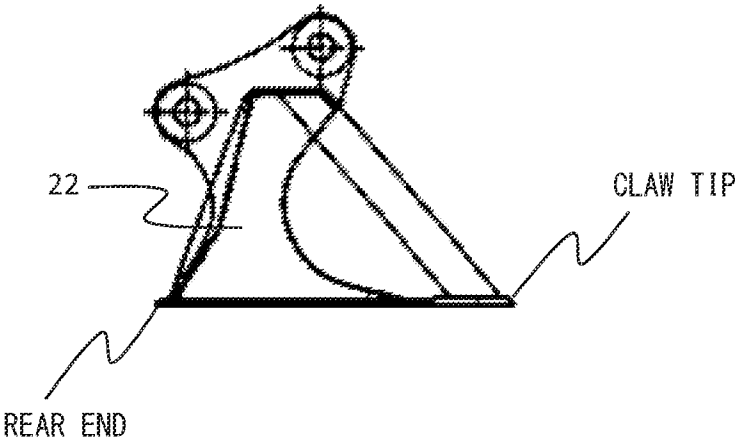
FIG. 9 is a side view of a slope finishing bucket.

The conditions for determining the work state of the bucket 22 are not limited to the above. For example, whether the work state is the excavating state or the rubbing state may be determined on the basis of the angle formed by the bottom surface of the bucket 22 and the excavation target surface. Moreover, when the bucket 22 is a slope finishing bucket (illustrated in FIG. 9) having an edge on the rear end side, a ground surface is sometimes excavated by the rear end side of the bucket 22, and hence, the state in which the bucket 22 proceeds toward the rear end side with a posture in which the rear end side is located lower than the claw tip side may be determined as the excavating state.

<Correction Method of Bucket Target Velocity >

Description will be given of a correction method to be used when the target velocity of the bucket 22 is corrected to make the distance between the bucket 22 and the excavation target surface shorter when machine control work is being executed. The correction of the target velocity of the bucket 22 is executed on the basis of the work state of the bucket 22 and the distance between the bucket 22 and the excavation target surface. In the present embodiment, when the bucket 22 proceeds toward the claw tip side in the state in which the claw tip side of the bucket 22 is lower than the rear end side, the displacement of the bucket cylinder 22A is computed to cause the distance between the claw tip of the bucket 22 and the excavation target surface to become zero, this displacement is divided by a predetermined time and then added to the target velocity of the bucket cylinder 22A computed by the target velocity computing section 310. The predetermined time mentioned here is the time taken until the distance between the claw tip of the bucket 22 and the excavation target surface becomes zero, and is decided as a proper value through an experiment or the like in consideration of characteristics of the hydraulic excavator 1 and so forth.

When the bucket 22 proceeds toward the claw tip side in the state in which the rear end side of the bucket 22 is lower than the claw tip side, the displacement of the bucket cylinder 22A is computed to cause the distance between the rear end of the bucket 22 and the excavation target surface to become zero, and the displacement is divided by the predetermined time and then added to the target velocity of the bucket cylinder 22A computed by the target velocity computing section 310. When the bucket 22 proceeds toward the rear end side in the state in which the rear end side of the bucket 22 is lower than the claw tip side, the displacement of the bucket cylinder 22A is computed to cause the distance between the rear end of the bucket 22 and the excavation target surface to become zero, and the displacement is divided by the predetermined time and then added to the target velocity of the bucket cylinder 22A computed by the target velocity computing section 310. When the bucket 22 proceeds toward the rear side in the state in which the claw tip side of the bucket 22 is lower than the rear end side, the displacement of the bucket cylinder 22A is computed to cause the distance between the claw tip of the bucket 22 and the excavation target surface to become zero, and the displacement is divided by the predetermined time and then added to the target velocity of the bucket cylinder 22A computed by the target velocity computing section 310.

Figure 10A:
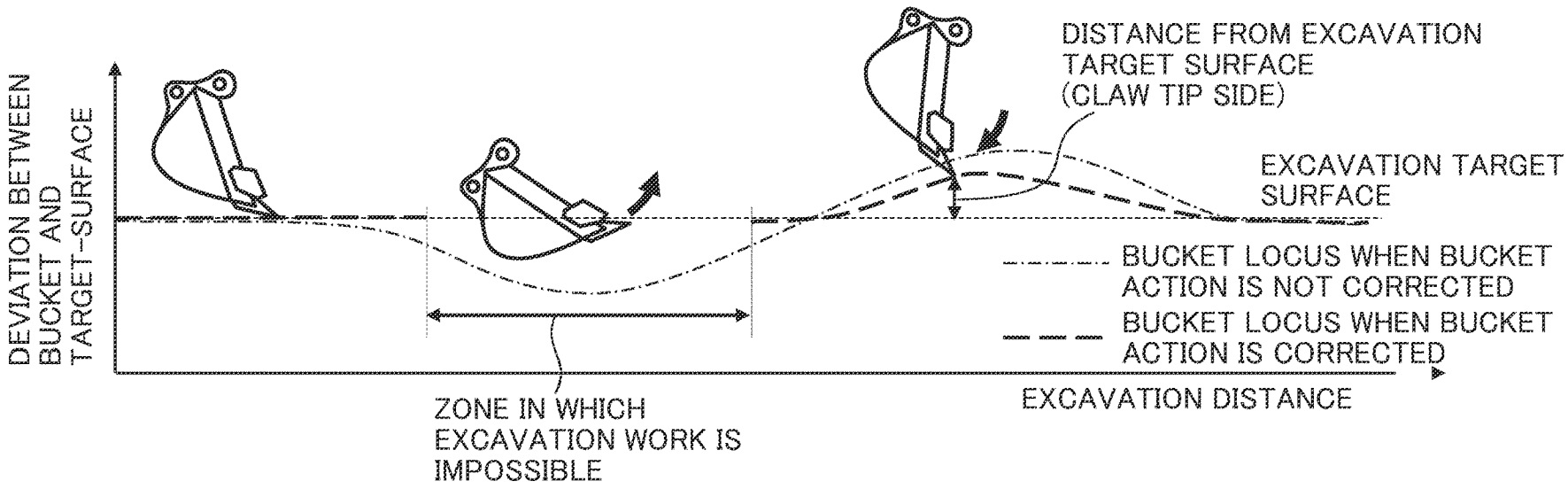
FIG. 10A is a diagram illustrating an action locus of the bucket under the machine control in a conventional technique.

Through the above, the distance between the bucket 22 and the excavation target surface can be made shorter by causing the bucket 22 to act, and the bucket 22 can be caused to follow the excavation target surface at a higher degree. However, in actual machine control work, a ground surface is excavated or is compacted through rubbing, and hence, as illustrated in FIG. 6, the claw tip of the bucket 22 recedes from the excavation target surface or bites into the lower side than the excavation target surface, thereby generating recesses and protrusions in the excavated ground surface. Accordingly, in conventional machine control, as illustrated in FIG. 10A, the action command value of the bucket 22 is corrected to cause the claw tip side of the bucket 22 to be oriented upward when the claw tip of the bucket 22 is located lower than the excavation target surface, thereby preventing digging down the ground surface deeply further. However, as a result, although the operator is executing operation intending excavation, the excavating state of the bucket 22 is deactivated contrary to the intention, and a zone in which excavation work is impossible is generated.

<Limiting Method of Bucket Target Velocity Correction>

Figure 10B:
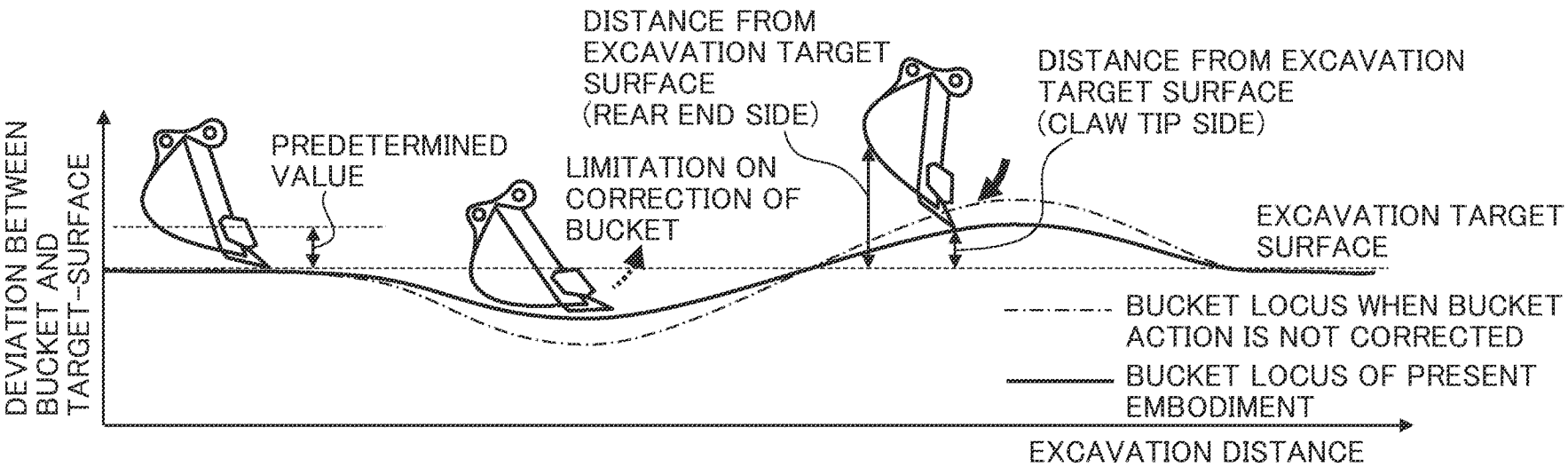
FIG. 10B is a diagram illustrating an action locus of the bucket under the machine control in the embodiment of the present invention.

To keep the excavating state of the bucket 22 in the "zone in which excavation work is impossible" illustrated in FIG. 10A, the rear end of the bucket 22 needs to be located on the upper side relative to the claw tip with the excavation target surface as a reference. As such, as illustrated in FIG. 10B, the action command value of the bucket cylinder 22A is corrected to keep the claw tip of the bucket 22 from being located on the upper side relative to the rear end with the excavation target surface as a reference. This eliminates the occurrence of the situation in which the rear end of the bucket 22 is located lower than the claw tip on the basis of the excavation target surface, and hence, the excavating state of the bucket 22 can be kept. In the case of keeping the rubbing state, it suffices to execute processing similar to the above with reversal of the vertical relation between the rear end and the claw tip of the bucket 22.

Apart from the above, when the angle of the bucket 22 significantly changes from the angle when bucket work is started (initial angle), there is a possibility that a sense of discomfort is given to the operator. Hence, a limit value is set for angle correction on the initial angle of the bucket 22 in advance. This can make a sense of discomfort for the user small and improve the work performance. Moreover, there is a possibility that a sense of discomfort is given to the operator also when the angle of the bucket 22 sharply changes. Hence, an upper limit value may be set for the action velocity or the angular velocity of the bucket cylinder 22A in advance. Moreover, the upper limit value of the action velocity of the bucket cylinder 22A may be changed according to the action velocity of the front work implement 2. These values are related to a sense of discomfort for the operator, and hence, it is desirable to decide the values by an experiment or the like.

Further, when keeping the angle of the bucket 22 with respect to the excavation target surface constant is being attempted, setting the above-described angle limitation or limitation on the angular velocity regarding the target kept angle of the bucket 22 makes it possible to make the distance between the bucket 22 and the excavation target surface shorter while keeping the angle of the bucket 22 with respect to the excavation target surface within a certain range.

<Action Locus of Bucket>

When the machine control in the conventional technique is used, as illustrated in FIG. 10A, the action of the bucket 22 is corrected to cause the claw tip of the bucket 22 to follow the excavation target surface without the posture of the bucket 22 with respect to the excavation target surface taken into consideration, and hence, the work state of the bucket 22 sometimes changes in the middle of a series of actions of the front work implement 2. For example, excavation work by the claw tip of the bucket 22 becomes impossible if the rear end of the bucket 22 is located lower than the claw tip in the middle of the series of actions although the work is started in the excavating state as illustrated in FIG. 10A. Further, rubbing work by the rear end of the bucket 22 becomes impossible if the claw tip of the bucket 22 is located lower than the rear end in the middle of the series of actions although the work is started in the rubbing state.

On the other hand, in the case in which the machine control in the present embodiment is used, as illustrated in FIG. 10B, when the claw tip of the bucket 22 has proceeded lower than the excavation target surface, the action of the bucket 22 is corrected to cause the claw tip of the bucket 22 to come close to the excavation target surface with the action of the bucket 22 limited to keep the bottom surface of the bucket 22 from being located lower than the claw tip. Owing to this, in the series of actions of the front work implement 2, the bucket 22 can be caused to follow the excavation target surface while the work state of the bucket 22 conforming to the intention of the operator is kept. Therefore, the work performance of the hydraulic excavator 1 improves.

Note that the relation between the size of the bucket 22 and the bucket locus in FIG. 10A and FIG. 10B is an image for explanation and is different from the actual scale.

<Control Procedure>

Figure 11:
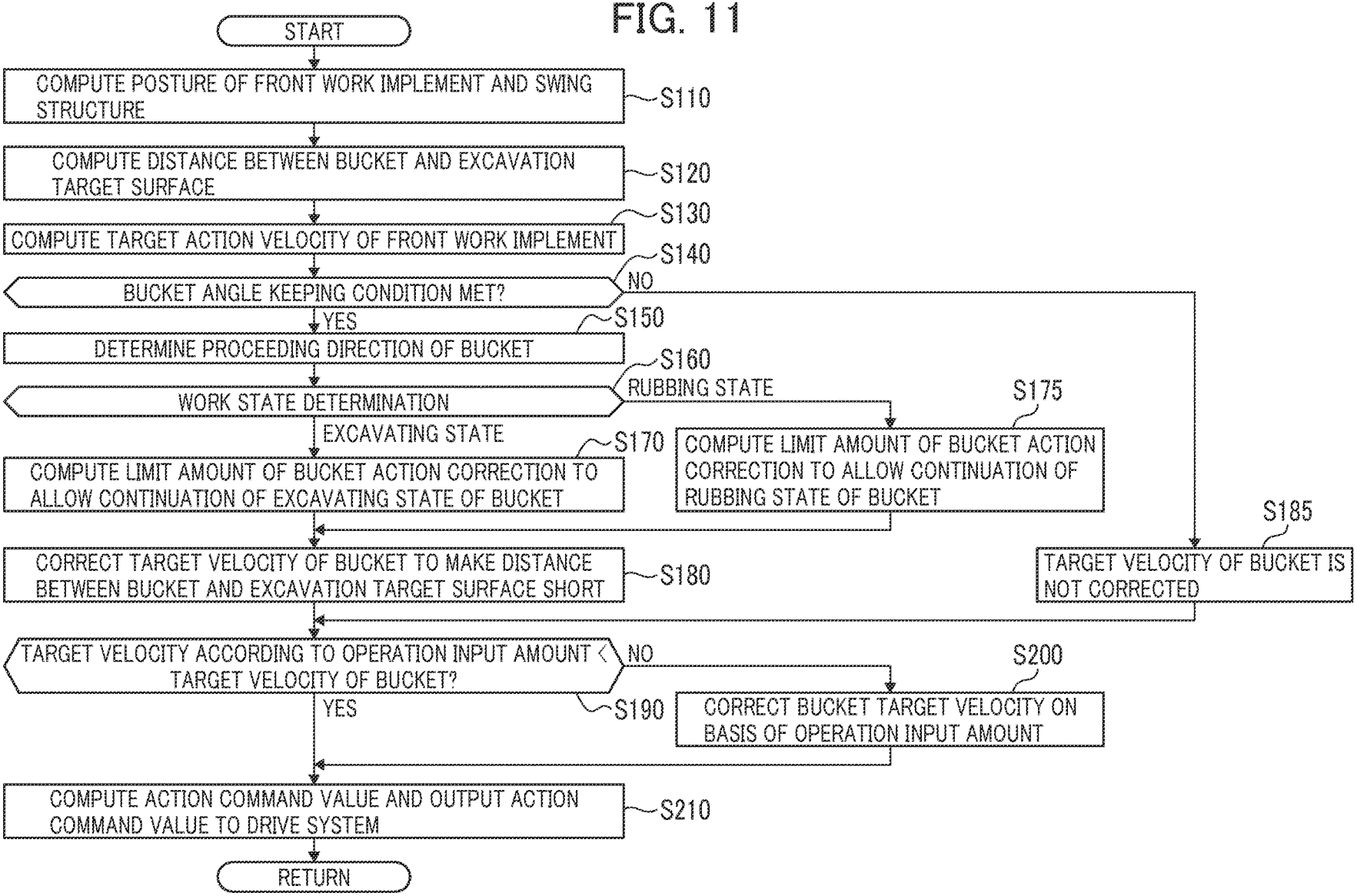
FIG. 11 is a flowchart illustrating the contents of processing of the information processing device in the embodiment of the present invention.

FIG. 11 is a flowchart illustrating the contents of processing of the information processing device 34. The respective steps will sequentially be described below.

In step S110, the posture of the front work implement 2 and the swing structure 3 is computed on the basis of signals obtained from the posture sensor 30.

In step S120, the distance between the bucket 22 and an excavation target surface is computed.

In step S130, the target velocity of the front work implement 2 is computed on the basis of the posture of the front work implement 2 and the swing structure 3, the distance between the bucket 22 and the excavation target surface, and the operation input amount from the operation input device 33.

In step S140, whether a bucket angle keeping condition holds is determined on the basis of the posture of the front work implement 2 and the swing structure 3, the positional relation between the bucket 22 and the excavation target surface, and the operation input amount from the operation input device 33. The bucket angle keeping condition mentioned here is a condition for determining whether the angle of the bucket 22 needs to be kept with respect to the excavation target surface, and refers to, for example, the case in which the distance between the bucket 22 and the excavation target surface is equal to or shorter than a predetermined value and an instruction regarding the action of the front work implement 2 is given. Proceeding to step S150 is made when the bucket angle keeping condition holds, and proceeding to step S185 is made when the bucket angle keeping condition does not hold.

In step S150, the proceeding direction of the bucket 22 is determined on the basis of the target velocity of the front work implement 2 and target surface information. Specifically, the proceeding direction of the bucket 22 is computed to be toward the claw tip side when the velocity component that is parallel to the excavation target surface and is toward the claw tip side in the target velocity of the bucket 22 is larger than the velocity component perpendicular to the excavation target surface. The proceeding direction of the bucket 22 is computed to be toward the rear end side when the velocity component that is parallel to the excavation target surface and is toward the rear end side in the target velocity of the bucket 22 is larger than the velocity component perpendicular to the excavation target surface.

In step S160, the work state of the bucket 22 is determined on the basis of the distance between the bucket 22 and the excavation target surface computed in step S120 and the proceeding direction of the bucket 22 determined in step S150. Proceeding to step S170 is made when the work state of the bucket 22 is the excavating state. Proceeding to step S175 is made when the work state is the rubbing state.

In step S170, the bucket correction limit value for keeping the excavating state of the bucket 22 is computed.

In step S175, the bucket correction limit value for keeping the rubbing state of the bucket 22 is computed.

In step S180, the target velocity of the bucket 22 is corrected to make the distance between the bucket 22 and the excavation target surface shorter within a range in which the action correction amount of the bucket 22 does not exceed the bucket correction limit value computed in step S170 or step S175.

In step S185, the target velocity of the bucket 22 is not corrected.

In step S190, it is determined whether the target velocity of the bucket 22 according to the operation input amount from the operation input device 33 is lower than the target velocity computed in step S180 or step S185.

Proceeding to step S210 is made when the operation input amount from the operation input device 33 is smaller than the target action computed in step S180 or step S185. Proceeding to step S200 is made when the target velocity according to the operation input amount from the operation input device 33 is equal to or higher than the target velocity computed in step S180 or step S185.

In step S200, the target velocity of the bucket 22 is corrected on the basis of the operation input amount from the operation input device 33.

In step S210, the action command value is computed on the basis of the target velocity of the bucket 22 and is outputted to the drive system 35.

Overview

In the present embodiment, in the work machine 1 including the machine main body 3, the front work implement 2 that is attached to the machine main body 3 vertically rotatably and has the work equipment 22, the actuators 20A, 21A, and 22A that drive the front work implement 2, the drive system 35 that drives the actuators 20A, 21A, and 22A, the operation input device 33 that gives an instruction regarding the action of the actuators 20A, 21A, and 22A, the posture sensor 30 that senses the posture of the machine main body 3 and the front work implement 2, the target surface information setting device 100 that sets a target surface that is to be excavated with the work equipment 22, and the controller 34*a* that computes the action command value of the actuators 20A, 21A, and 22A on the basis of information inputted from the operation input device 33, the posture sensor 30, and the target surface information setting device 100, to cause the work equipment 22 to move along the target surface, and outputs the action command value to the drive system 35, the controller 34*a* determines the work state of the work equipment 22 on the basis of the operation input amount inputted from the operation input device 33 and the posture of the work equipment 22 with respect to the target surface, computes a range of the action command value of the actuators 20A, 21A, and 22A in which the work state determined is kept, and corrects, within the range, the action command value of the actuators to make the distance between the work equipment 22 and the target surface shorter. In the present embodiment, made is the configuration in which the action command value of the actuators 20A, 21A, and 22A is indirectly corrected by correction of the target velocity of the bucket 22. However, the action command value of the actuators 20A, 21A, and 22A may be directly corrected.

According to the present embodiment configured as above, it becomes possible to improve the work performance of the hydraulic excavator 1 by keeping the work state of the work equipment 22 conforming to the intention of the operator in the machine control for causing the work equipment 22 to follow the excavation target surface.

Moreover, the controller 34*a* in the present embodiment determines the work state of the work equipment 22 at the timing when the distance between the work equipment 22 and the target surface has become equal to or shorter than a predetermined value and the velocity component parallel to the target surface in the target velocity of the work equipment 22 computed on the basis of the operation input amount has become larger than the velocity component perpendicular to the target surface. This makes it possible to determine the work state of the work equipment 22 at the timing when work by the work equipment 22 is started.

Further, the controller 34*a* in the present embodiment determines the work state of the work equipment 22 on the basis of the posture and the proceeding direction of the work equipment 22 with respect to the target surface. This makes it possible to improve the accuracy of determination of the work state of the work equipment 22.

Further, the controller 34*a* in the present embodiment senses the posture of the work equipment 22 with respect to the target surface on the basis of the distances between two points set on the work equipment 22 in advance (point on the claw tip side and point on the rear end side) and the target surface. This makes it possible to sense the posture of the work equipment 22 with respect to the excavation target surface in a simplified manner.

Further, the work equipment 22 in the present embodiment is a bucket, and the controller 34*a* determines that the work state of the bucket 22 is the excavating state when the claw tip of the bucket 22 is located lower than the rear end side of the bucket 22 with the target surface as a reference and the velocity component that is parallel to the target surface and is toward the claw tip side in the target velocity of the bucket 22 is larger than the velocity component perpendicular to the target surface. In addition, the controller 34*a* determines that the work state of the bucket 22 is the rubbing state when the claw tip is located lower than the rear end side with the target surface as a reference and the velocity component that is parallel to the target surface and is toward the rear end side in the target velocity of the bucket 22 is larger than the velocity component perpendicular to the target surface or when the rear end side is located lower than the claw tip with the target surface as a reference and the velocity component parallel to the target surface in the target velocity of the bucket 22 is larger than the velocity component perpendicular to the target surface. Owing to this, in the hydraulic excavator 1 on which the bucket 22 is mounted as work equipment, it becomes possible to precisely determine which of the excavating state and the rubbing state the work state of the bucket 22 is.

Further, when determining that the work state of the bucket 22 is the excavating state, the controller 34*a* in the present embodiment corrects the action command value of the actuators 20A, 21A, and 22A to make the distance from the claw tip to the target surface shorter within a range of the action command value in which the state in which the claw tip is located lower than the rear end side with the target surface as a reference is kept. In addition, when determining that the work state of the bucket 22 is the rubbing state, the controller 34*a* corrects the action command value of the actuators 20A, 21A, and 22A to make the distance from the claw tip to the target surface shorter within a range of the action command value in which the state in which the rear end side is located lower than the claw tip with the target surface as a reference is kept. This makes it possible to improve the work performance of the hydraulic excavator 1 by keeping the work state (excavating state or rubbing state) of the bucket 22 conforming to the intention of the operator in the machine control for causing the bucket 22 to follow the excavation target surface.

Moreover, the controller 34*a* in the present embodiment corrects the action command value of the actuators 20A, 21A, and 22A such that the angle change amount of the work equipment 22 does not exceed an angle correction limit value set in advance or the angular velocity change amount of the work equipment 22 does not exceed an angular velocity correction limit value set in advance. Owing to this, the variation width of the posture of the work equipment 22 in work is suppressed to a certain width or smaller, making it possible to reduce a sense of discomfort given to the operator.

Further, the controller 34*a* in the present embodiment computes the angle correction limit value or the angular velocity correction limit value of the work equipment 22 on the basis of the action velocity of the front work implement 2 and corrects the action command value of the actuators 20A, 21A, and 22A such that the angle change amount of the work equipment 22 does not exceed the angle correction limit value or the angular velocity change amount of the work equipment 22 does not exceed the angular velocity correction limit value. Owing to this, the variation width of the posture of the work equipment 22 in work is suppressed according to the action velocity of the front work implement 2, making it possible to further reduce a sense of discomfort given to the operator.

Although the embodiment of the present invention has been described in detail above, the present invention is not limited to the above-described embodiment, and various modification examples are included therein. For example, the above-described embodiment is one that is described in detail in order to explain the present invention in an easy-to-understand manner and is not necessarily limited to one that includes all configurations described.

DESCRIPTION OF REFERENCE CHARACTERS

1: Hydraulic excavator (work machine)
2: Front work implement
3: Swing structure (machine main body)
4: Track structure
10: Control system
20: Boom
20A: Boom cylinder (actuator)
20S: Boom IMU
21: Arm
21A: Arm cylinder (actuator)
215: Arm IMU
22: Bucket (work equipment)
22A: Bucket cylinder (actuator)
22B: First link
22C: Second link
22S: Bucket IMU
305: Swing structure IMU
31: Main frame
32: Cab
33: Operation input device
34: Information processing device
35: Drive system
36: Prime mover device
37: Counterweight
38: Motor for swing (actuator)
40: Track frame
41: Motor for travelling (actuator)
45: Crawler
100: Target surface information setting device
100*a*: Controller for target surface information setting
110: Display setting device
110*a*: Display monitor
110*b*: Touch panel
210: Posture computing section
220: Target surface distance computing section
310: Target velocity computing section
410: Bucket angle control deciding section
420: Bucket proceeding direction determining section
430: Bucket work state determining section
440: Bucket correction limit value computing section
450: Bucket target velocity correcting section
610: Action command value computing section

The invention claimed is:

1. A work machine comprising:

a machine main body;

a front work implement that is attached to the machine main body vertically rotatably and has a boom, an arm and a bucket;

a plurality of actuators that drive the front work implement;

a drive system that drives the plurality of actuators;

an operation input device that gives an instruction regarding an action of the plurality of actuators;

a posture sensor that senses posture of the machine main body and the front work implement;

a target surface information setting device that sets a target surface that is to be excavated with the bucket; and a controller that computes an action command value of a boom cylinder among the plurality of actuators on a basis of information inputted from the operation input device, the posture sensor, and the target surface information setting device, to cause the bucket to move along the target surface, and outputs the action command value to the drive system, wherein the controller is configured to:

determine a work state of the bucket, whether it is in an excavating state or a rubbing state, on a basis of an operation input amount inputted from the operation input device and posture of the bucket with respect to the target surface, in a case of determining that the work state of the bucket is the excavating state, correct the action command value of a bucket cylinder among the plurality of actuators to cause a claw tip of the bucket to come close to the target surface, within a range of the action command value in which a state in which the claw tip of the bucket is located lower than a rear end side of the bucket while maintaining the target surface as a reference, in a case of determining that the work state of the bucket is the rubbing state, correct the action command value of the bucket cylinder among the plurality of actuators to cause the claw tip of the bucket to come close to the target surface, within a range of the action command value in which a state in which the rear end side of the bucket is located lower than the claw tip of the bucket while maintaining the target surface as a reference, determine the work state of the bucket on a basis of the posture and a proceeding direction of the bucket with respect to the target surface, sense the posture of the bucket with respect to the target surface on a basis of distances between two points set on the bucket in advance and the target surface, determine that the work state of the bucket is the excavating state in a case where a claw tip of the bucket is located lower than a rear end side of the bucket with the target surface as a reference and a velocity component that is parallel to the target surface and that is toward a side of the claw tip in an action velocity of the bucket is larger than a velocity component perpendicular to the target surface, and determine that the work state of the bucket is the rubbing state in a case where the claw tip is located lower than the rear end side with the target surface as a reference and a velocity component that is parallel to the target surface and that is toward the rear end side in the action velocity of the bucket is larger than the velocity component perpendicular to the target surface or in a case where the rear end side is located lower than the claw tip with the target surface as a reference and a velocity component parallel to the target surface in the action velocity of the bucket is larger than the velocity component perpendicular to the target surface.

2. The work machine according to claim 1, wherein the controller is configured to determine the work state of the bucket at a timing when the distance between the bucket and the target surface has become equal to or shorter than a predetermined value and a velocity component parallel to the target surface in a target velocity of the bucket computed on a basis of the operation input amount has become larger than a velocity component perpendicular to the target surface.

3. The work machine according to claim 1, wherein the controller is configured to correct the action command value of the actuators such that an angle change amount of the bucket does not exceed an angle correction limit value set in advance or an angular velocity change amount of the bucket does not exceed an angular velocity correction limit value set in advance.

4. The work machine according to claim 1, wherein the controller is configured to:

compute an angle correction limit value or an angular velocity correction limit value of the bucket on a basis of action velocity of the front work implement, and correct the action command value of the actuators such that an angle change amount of the bucket does not exceed the angle correction limit value or an angular velocity change amount of the bucket does not exceed the angular velocity correction limit value.

* * * * *